US006516233B1

(12) United States Patent
Bhagwat et al.

(10) Patent No.: US 6,516,233 B1
(45) Date of Patent: Feb. 4, 2003

(54) PULSE PLATING RECTIFIERS AND METHODS, SYSTEMS AND COMPUTER PROGRAM PRODUCTS FOR CONTROLLING PULSE PLATING RECTIFIERS IN MASTER/SLAVE MODE

(75) Inventors: Pradeep M. Bhagwat, Baltimore, MD (US); Tom Goodman, Howell, NJ (US); Vinod Bapat, Holmdel, NJ (US)

(73) Assignee: Lambda EMI, Inc., Neptune, NJ (US)

( * ) Notice: Subject to any disclaimer, the term of this patent is extended or adjusted under 35 U.S.C. 154(b) by 339 days.

(21) Appl. No.: 09/595,270

(22) Filed: Jun. 15, 2000

(51) Int. Cl.[7] ..... G05B 19/18

(52) U.S. Cl. ..... 700/3; 700/2; 700/5; 700/52; 700/32; 700/119; 700/123; 427/98; 427/526; 427/523; 204/298.05; 204/434; 204/224 R; 438/FOR 390

(58) Field of Search ..... 700/119–123, 2–5, 700/31–36, 67–75, 46–52; 363/26, 81, 95–97, 127–129, 21.16–21.18, 37, 58, 71–72, 65; 388/813, 907.5, 912, 917; 204/298.05, 230.8, 224 R, 434; 427/98, 526, 523; 438/FOR 390

(56) References Cited

U.S. PATENT DOCUMENTS

| | | | | | |
|---|---|---|---|---|---|
| 3,823,362 | A | * | 7/1974 | Bailey | 219/779 |
| 3,996,125 | A | * | 12/1976 | Kondo et al. | 204/229.3 |
| 4,009,091 | A | * | 2/1977 | Washington et al. | 204/229.3 |
| 4,071,900 | A | * | 1/1978 | Jensen | 318/812 |
| 4,174,534 | A | | 11/1979 | Kotlarewsky | 363/26 |
| 4,346,432 | A | * | 8/1982 | Gurr | 327/39 |
| 4,356,541 | A | * | 10/1982 | Ikenoue et al. | 363/126 |
| 4,378,281 | A | * | 3/1983 | Scanlon et al. | 204/198 |
| 4,565,953 | A | | 1/1986 | Espelage et al. | 318/345 |
| 4,765,878 | A | | 8/1988 | Komoto et al. | 204/211 |
| 4,870,555 | A | * | 9/1989 | White | 363/127 |
| 4,886,981 | A | | 12/1989 | Lentini et al. | 307/87 |
| 5,119,073 | A | | 6/1992 | Nelson et al. | 340/661 |
| 5,757,634 | A | | 5/1998 | Ferens | 363/72 |
| 5,914,022 | A | | 6/1999 | Lowry et al. | 205/83 |
| 5,956,244 | A | * | 9/1999 | Rehm et al. | 363/44 |
| 6,307,763 | B1 | * | 10/2001 | Chavez et al. | 363/70 |
| 6,381,257 | B1 | * | 4/2002 | Ershov et al. | 372/108 |

FOREIGN PATENT DOCUMENTS

| | | |
|---|---|---|
| WO | WO 99/41817 | 8/1999 |

OTHER PUBLICATIONS

Copy of International Search Report for PCT/US01/19413, Jun. 15, 2001.

*RS–422 and RS–485 Application Note*. B & B Electronics, Ottowa, IL, pp. 1–41, (Oct. 1997).

* cited by examiner

*Primary Examiner*—Ramesh Patel
(74) *Attorney, Agent, or Firm*—Myers Bigel Sibley & Sajovec

(57) ABSTRACT

Methods, systems and computer program products for controlling plating pulse rectifiers are provided by identifying one of the plurality of plating pulse rectifiers as a master plating pulse rectifier and identifying at least one of the plurality of plating pulse rectifiers, other than the master plating pulse rectifier, as a slave plating pulse rectifier. A recipe comprising a pulse pattern is downloaded to the master plating pulse rectifier and the slave plating pulse rectifier. A synchronization signal is transmitted from the master plating pulse rectifier upon initiating the pulse pattern of the recipe to the at least one slave plating pulse rectifier so as to cause the slave plating pulse rectifier to initiate the pulse pattern of the downloaded recipe. Plating pulse rectifiers suitable for use as master/slave plating pulse rectifiers and systems incorporating such plating pulse rectifiers are also provided.

51 Claims, 6 Drawing Sheets

PULSE PLATING RECTIFIERS AND METHODS, SYSTEMS AND COMPUTER PROGRAM PRODUCTS FOR CONTROLLING PULSE PLATING RECTIFIERS IN MASTER/SLAVE MODE

FIELD OF THE INVENTION

The present invention relates to pulse plating rectifiers, and more particularly, to the parallel use of pulse plating rectifiers.

BACKGROUND OF THE INVENTION

In a conventional pulse plating operation, several pulse rectifiers may be installed which are controlled by a common programmable logic controller (PLC). Typically, these pulse rectifiers do not include their own PLCs but are controlled by the common PLC. In operation a "recipe" of pulse patterns may be programmed into the PLC and the single PLC controls the multiple pulse rectifiers. The "recipe" typically defines the pattern of pulses which are to be generated by the pulse rectifiers and may differ from application to application.

Because the recipe is dynamic, in that it may change from application to application, typically, the common PLC controls all the pulse rectifiers which are to the power output over a single rectifier. The parallel pulse rectifiers typically are synchronized by the common PLC based on the particular recipe programmed into the PLC to avoid large circulating currents between the pulse rectifiers.

However, use of a single PLC may result in programming complexity as multiple pulse rectifiers carrying out differing recipes may be associated with the same PLC. The synchronization of the pulse rectifiers to the differing recipes would be controlled by the single PLC. Thus, in certain situations the ability to provide parallel operation of the pulse rectifiers may be limited by the capabilities of the common PLC. In such situations it may be possible to provide an additional PLC to control some of the pulse rectifiers but such a solution may necessitate maintaining an inventory of PLCs and/or pulse rectifiers which may need reconfiguration between operation of different recipes or recipe combinations to accommodate the differing recipes and recipe combinations. Thus, flexibility of a plating system may be reduced because a dedicated PLC is typically utilized to control a bank of pulse rectifiers.

In light of the above discussion, a need exists for improvements in plating rectifiers and/or systems utilizing plating rectifiers.

SUMMARY OF THE INVENTION

Embodiments of the present invention include plating pulse rectifiers which include a control computer and a power module operably associated with the control computer so as to output pulses based on control signals provided by the control computer. A master/slave mode selector is operably associated with the control computer so as to define the plating pulse rectifier as either a master plating pulse rectifier or a slave plating pulse rectifier. A data bus is operably associated with the control computer and configured to receive recipes to be loaded into the control computer and a sync bus is operably associated with the control computer and configured so as to transmit synchronization signals if the plating pulse rectifier is a master plating pulse rectifier and receive synchronization signals if the plating pulse rectifier is a slave plating pulse rectifier.

In further embodiments of the present invention, the control computer is configured to transmit a synchronization signal on the sync bus at the start of a pattern of a recipe loaded in the control computer if the plating pulse rectifier is a master plating pulse rectifier. Similarly, the control computer may also be configured to receive a synchronization signal on the sync bus and control the power module to output a pattern pulse of a recipe loaded in the control computer responsive to receiving the synchronization signal.

In particular embodiments of the present invention, the data bus comprises a RS-485 serial bus. Similarly, the sync bus may comprise a RS-485 serial bus.

In still further embodiments, the master/slave mode selector comprises a switch operably associated with the control computer. The switch may be configured to provide a first voltage level to the control computer if the plating pulse rectifier is a master plating pulse rectifier and a second voltage level, different from the first voltage level, if the plating pulse rectifier is a slave plating pulse rectifier. In such embodiments, the control computer may also be configured to read a voltage level provided by the switch and to define the plating pulse rectifier as a master plating pulse rectifier if the voltage level is the first voltage level and define plating pulse rectifier as a slave plating pulse rectifier if the voltage level is a second voltage level.

Furthermore, the master/slave mode selector may comprise a bit in a loadable control register in the control computer. In such embodiments, the loadable control register may be loadable from the data bus.

In still further embodiments of the present invention, a plating system may be provided which includes at least two plating pulse rectifiers. The at least two plating pulse rectifiers include a control computer, a power module operably associated with the control computer so as to output pulses based on control signals provided by the control computer, a master/slave mode selector operably associated with the control computer so as to define each plating pulse rectifier as either a master plating pulse rectifier or a slave plating pulse rectifier, a data bus operably associated with the control computer and configured to receive recipes to be loaded into the control computer, and a sync bus operably associated with the control computer and configured so as to transmit synchronization signals if the plating pulse rectifier is a master plating pulse rectifier and receive synchronization signals if the plating pulse rectifier is a slave plating pulse rectifier. One of the at least two plating pulse rectifiers is defined as a master plating pulse rectifier and the other of the at least two plating pulse rectifiers is defined as a slave plating pulse rectifier.

The sync bus of the master plating pulse rectifier and the sync bus of the slave plating pulse rectifier are also operably connected so that the synchronization pulse transmitted by the master plating pulse rectifier may be received by the slave plating pulse rectifier. Furthermore, the sync bus of the master plating pulse rectifier may be operably connected to only the sync of slave plating pulse rectifiers associated with the master plating pulse rectifier.

Furthermore, the plating system may further include a computer operably associated with the plurality of plating pulse rectifiers and configured to download recipes to the plurality of plating pulse rectifiers.

Further embodiments of the present invention provide methods, systems and computer program products for controlling plating pulse rectifiers by identifying one of the plurality of plating pulse rectifiers as a master plating pulse rectifier and identifying at least one of the plurality of plating pulse rectifiers, other than the master plating pulse rectifier, as a slave plating pulse rectifier. A recipe comprising a pulse pattern is downloaded to the master plating pulse rectifier and the slave plating pulse rectifier. A synchronization signal is transmitted from the master plating pulse rectifier upon initiating the pulse pattern of the recipe to the at least one slave plating pulse rectifier so as to cause the slave plating pulse rectifier to initiate the pulse pattern of the downloaded recipe.

In still further embodiments of the present invention, the synchronization signal is transmitted at the initiation of each pulse pattern in the downloaded recipe.

In additional embodiments of the present invention, the identification of one of the plurality of plating pulse rectifiers as a master plating pulse rectifier may be accomplished by setting a master/slave switch on the one of the plurality of plating pulse rectifiers identified as the master plating pulse rectifier to a master position and reading the position of the master/slave switch to identify the one of the plurality of plating pulse rectifiers as the master plating pulse rectifier based on the position of the master/slave switch. Furthermore, the position of the master/slave switch may be read at power up.

In yet additional embodiments of the present invention, the identification of at least one of the plurality of plating pulse rectifiers as a slave plating pulse rectifier may be accomplished by setting a master/slave switch on the at least one of the plurality of plating pulse rectifiers other than the master plating pulse rectifier to a slave position and reading the position of the master/slave switch to identify the at least one of the plurality of plating pulse rectifiers as a slave plating pulse rectifier based on the position of the master/slave switch.

In still further embodiments of the present invention, the synchronization signal is received at the at least one slave plating pulse rectifier and the pulse pattern of the downloaded recipe initiated responsive to receiving the synchronization signal. The pulse pattern may be initiated responsive to receiving the synchronization signal irrespective of whether a previous pulse pattern of the downloaded recipe has completed.

In other embodiments of the present invention, the recipe may be downloaded by transmitting the recipe onto a data bus operably associated with the plurality of plating pulse rectifiers and receiving the transmitted recipe at the master plating pulse rectifier and the at least one slave plating pulse rectifier. Furthermore, the recipe may be transmitted onto the data bus with a first address associated with the master plating pulse rectifier and also transmitted onto the data bus with a second address associated with the at least one slave plating pulse rectifier.

In particular embodiments of the present invention, the transmission of a synchronization signal from the master plating pulse rectifier upon initiating the pulse pattern of the recipe to the at least one slave plating pulse rectifier so as to cause the slave plating pulse rectifier to initiate the pulse pattern of the downloaded recipe may be carried out by transmitting a synchronization pulse on a sync bus operably associated with the master plating pulse rectifier,and the at least one slave plating pulse rectifier.

While the invention has been described above primarily with respect to method aspects of the invention, both systems and/or computer program products are also provided.

BREIF DESCRIPTION OF THE DRAWINGS

DETAILED DESCRIPTION OF EMBODIMENTS OF THE PRESENT INVENTION

Figure 1A:
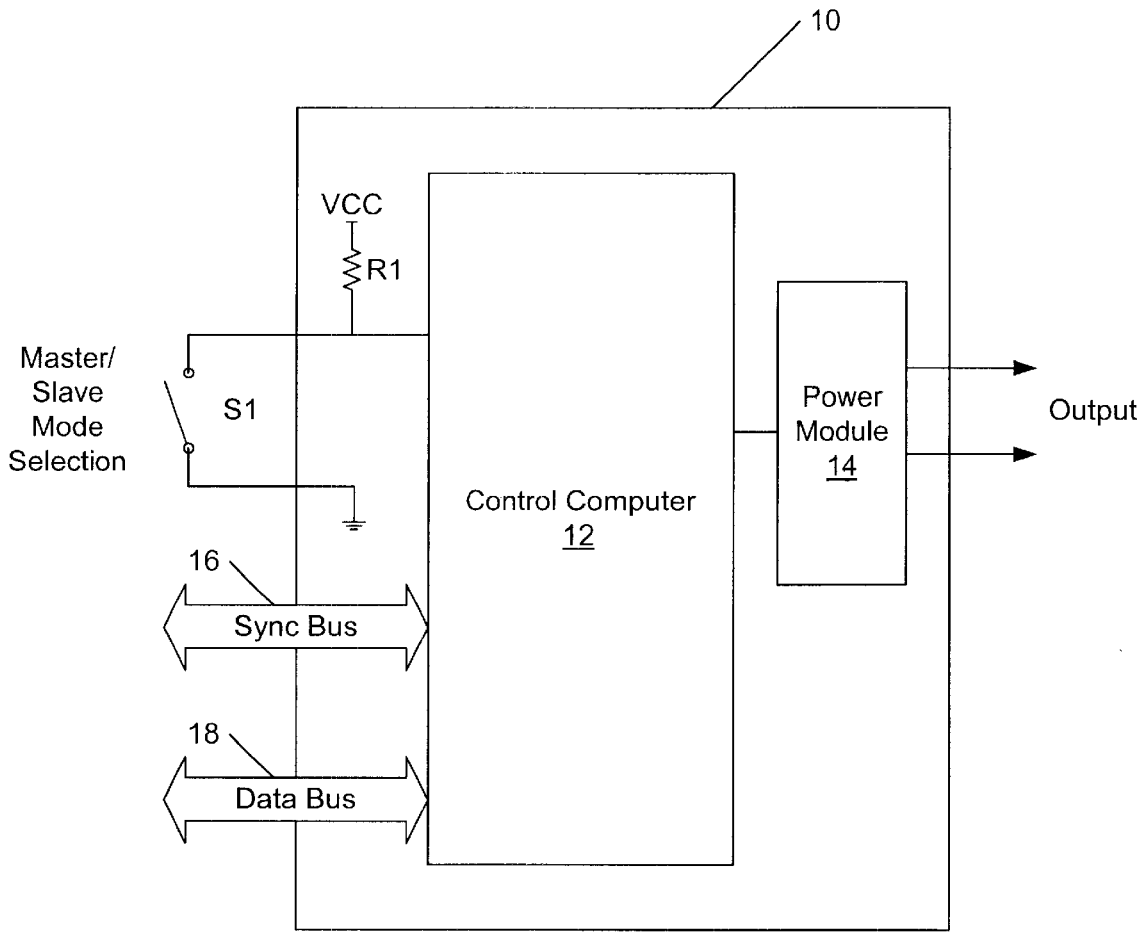
FIG. 1A is a block diagram of a plating pulse rectifier according to embodiments of the present invention.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As will be appreciated by one of skill in the art, the present invention may be embodied as methods, systems, or computer program products. Accordingly, the present invention may take the form of an entirely hardware embodiment, an entirely software embodiment or an embodiment combining software and hardware aspects.

Furthermore, the present invention may take the form of a computer program product on a computer-usable storage medium having computer-usable program code means embodied in the medium. Any suitable computer readable medium may be utilized including hard disks, CD-ROMs, optical storage devices, or magnetic storage devices.

Computer program code for carrying out operations of the present invention may be written in an object oriented programming language such as Java, Smalltalk or C++. However, the computer program code for carrying out operations of the present invention may also be written in conventional procedural programming languages, such as the "C" programming language or specialty programming languages such as programming languages for programming programmable logic controllers (PLCs). The program code may execute entirely on a single processing system or on multiple processing systems.

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, programmable controller or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart and/or block diagram block or blocks.

As is described in more detail below, particular embodiments of the present invention provide for master/slave control of a plurality of plating pulse rectifiers. According to various embodiments of the present invention, a plating pulse rectifier is identified as either a master or a slave by, for example, a switch setting of the plating pulse rectifier. The master plating pulse rectifier then controls the start of recipe patterns loaded in the slave plating pulse rectifiers by issuing synchronization signals to the slave plating pulse rectifiers. Thus, the slave plating pulse rectifiers may be controlled by the master plating pulse rectifier so as to avoid problems which may be associated with unsynchronized plating pulse rectifiers operating in parallel. Various embodiments of the present invention will now be described with reference to FIGS. 1A through 5.

Referring now to FIG. 1A, a plating pulse rectifier 10 includes a control computer 12. The control computer 12 may be capable of being loaded with a recipe which defines a pattern or patterns of pulses which are to be generated by the plating pulse rectifier 10 and outputs signals to generate such pulses. As described in more detail below, the control computer 12 may be a programmable controller, an embedded processor, a general purpose processor and/or other such data processing systems capable of carrying out the operations described herein.

The plating pulse rectifier 10 also includes a power module 14 which is controlled by the control computer 12 to output pulses. The power module 14 may be a conventional pulse rectifier circuit or other such pulse generation circuits known to those of skill in the art and, therefore, need not be described in further detail herein.

The control computer 12 may also have associated with it a data bus 18 which may be utilized to load recipes or other programs or data into the control computer. The control computer 12 may also have associated with it a sync bus 16 for sending and receiving synchronization signals so as to allow a plurality of plating pulse rectifiers 10 to operate in parallel. Operation and use of the data bus 18 and the sync bus 16 are described in further detail below. A common bus could also be utilized in particular systems, for example, utilizing different data fields of messages or through the coordination of timing of sync information and recipe data information. Thus, the sync bus 16 and the data bus 18 may be separate buses or may be the same bus.

As illustrate in FIG. 1A, the data bus 18 and the sync bus 16 may be separate buses, and in particular, may be RS-485 serial buses. RS-485 serial interfaces are commercially available and known to those of skill in the art and will, therefore, not be described further herein. However, the data bus 18 may also be provided by other types of communication interfaces suitable for the transfer of data. For example, the data bus 18 could be an Ethernet or other such network, including, for example, a wireless network or even the Internet or an intranet. In such cases, the appropriate network interface could be incorporated into the control computer 12 or otherwise incorporated in the plating pulse rectifier 10.

Finally, the plating pulse rectifier 10 may also include a master/slave mode selection switch S1 which may be a single pole single throw (SPST) switch having one contact pulled up to VCC or other suitable voltage by, for example, pull-up resistor R1, and the other contact tied to another voltage, such as ground. Other conventional switches may also be used. As is seen in FIG. 1A, the switch S1 may provide a first voltage, such as ground, to the control computer 12 when the switch S1 is closed and a second voltage to the control computer 12, such as VCC, when the switch S1 is open. Thus, the control computer 12 may sense the voltage provided by switch S1 to determine if the plating pulse rectifier 10 is defined as a master plating pulse rectifier or a slave plating pulse rectifier. Such a determination may be made at power up or otherwise.

Figure 1B:
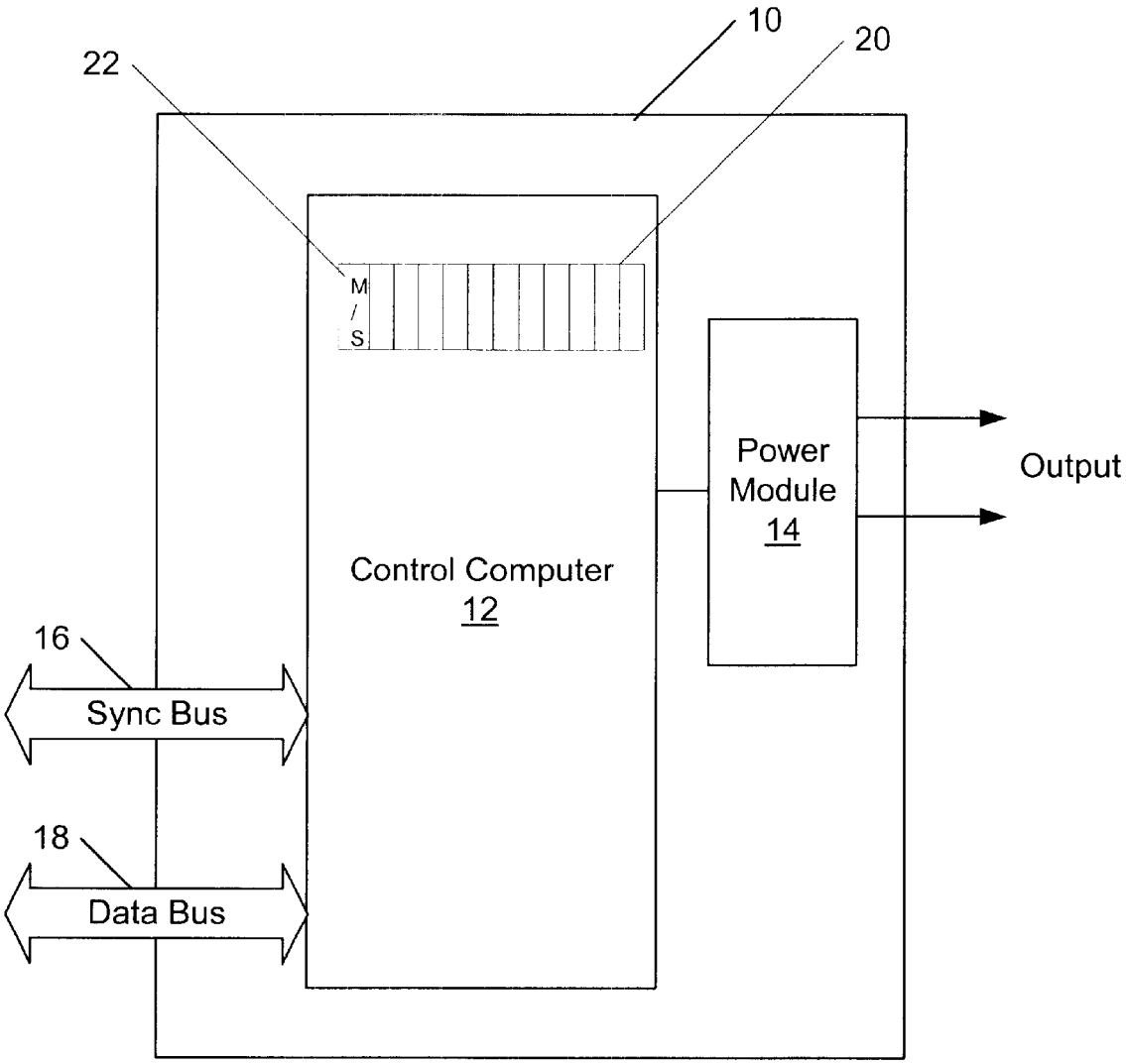
FIG. 1B is a block diagram of a plating pulse rectifier according to alternative embodiments of the present invention.

Alternatively, as illustrated in FIG. 1B, the control computer 12 may also have a loadable register 20 which, for example, includes a bit 22 which defines the plating pulse rectifier 10 as either a master or a slave. The bit 22 could be set based on messages or data received over the data bus 18. Alternatively, the bit 22 could be set by reading the voltage provided by switch S1 of FIG. 1A as a logic level. The status of the bit 22 could be utilized to determine if the plating pulse rectifier 10 was a master or a slave. In addition to the loadable register 20 and the switch S1, other mechanisms known to those of skill in the art for defining a device as a master or a slave may also be utilized to provide master/slave mode selector. For example, a jumper or other such device could identify the plating pulse rectifier 10 as a master or a slave.

Figure 2:
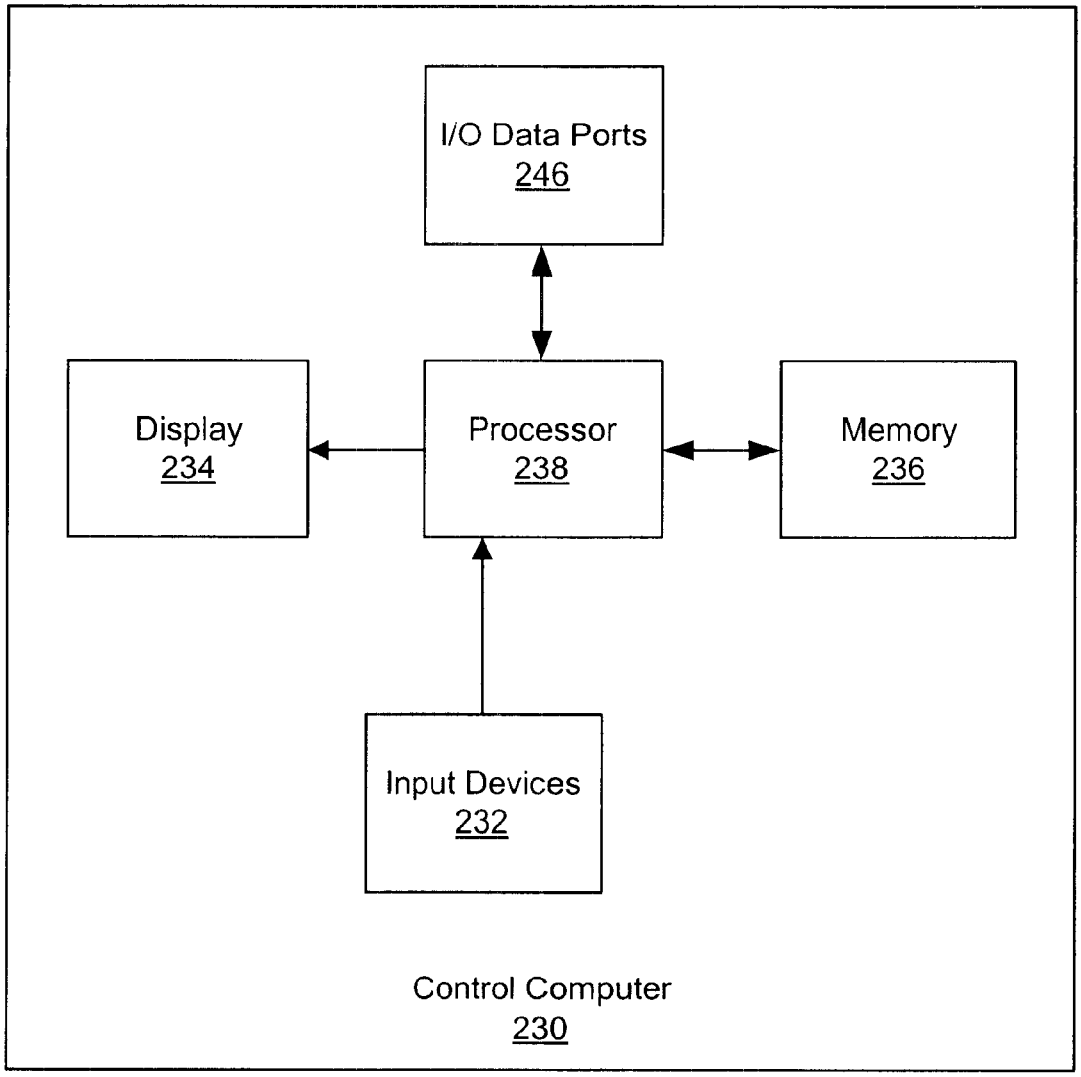
FIG. 2 is a block diagram of a data processing system suitable for use as the control computer of a plating pulse rectifier according to embodiments of the present invention.

An exemplary embodiment of a data processing system 230 suitable for use as the control computer 10 is illustrated in FIG. 2 and may optionally include input device(s) 232 such as a keyboard or keypad, a display 234, as well as a memory 236 that communicate with a processor 238. The data processing system 230 may further include I/O data port(s) 246 that also communicate with the processor 238. The I/O data port 246 can be used to transfer information between the data processing system 230 and another computer system or a network. These components may be conventional components such as those used in many conventional data processing systems which may be configured in-accordance with the present invention to operate as described herein.

Figure 3:
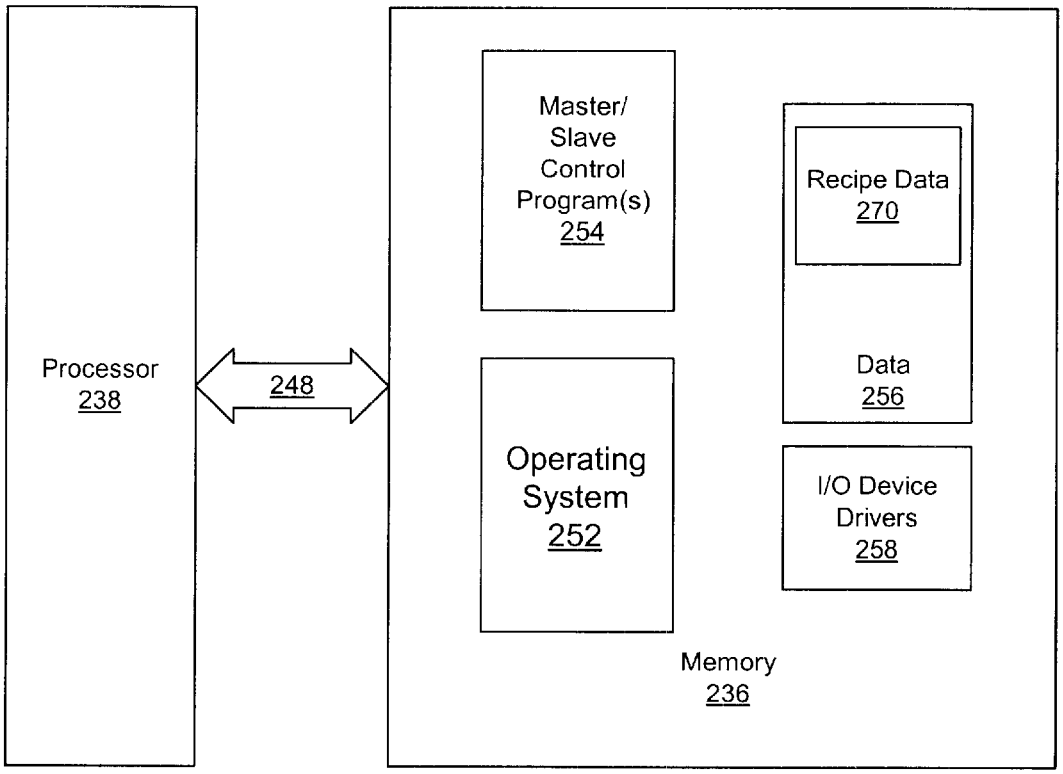
FIG. 3 is a more detailed block diagram of a control computer suitable according to embodiments of the present invention.

FIG. 3 is a block diagram of data processing systems that illustrates systems, methods, and computer program products in accordance with embodiments of the present invention. The processor 238 communicates with the memory 236 via an address/data bus 248. The processor 238 can be any commercially available or custom processor such as conventional microprocessors. The memory 236 is representative of the overall hierarchy of memory devices containing the software and data used to implement the functionality of the data processing system 230. The memory 236 can include, but is not limited to, the following types of devices: cache, ROM, PROM, EPROM, EEPROM, flash, SRAM, and DRAM.

As shown in FIG. 3, the memory 236 may contain several categories of software and data used in the data processing system 230: the operating system 252; the master/slave control program(s) 254; the input/output (I/O) device drivers 258; and the data 256. As will be appreciated by those of skill in the art, the operating system 252 may be any operating system suitable for use with a data processing system, and may include task specific operating systems such as those utilized by conventional PLCs or may be a general purpose operating system such as OS/2 or AIX from International Business Machines Corporation, Armonk, N.Y., WindowsNT, Windows95, Windows98 or Windows2000 from Microsoft Corporation, Redmond, Wash., Unix or Linux.

The I/O device drivers 258 typically include software routines accessed through the operating system by the application programs such as the master/salve control program(s) 254 to communicate with devices such as the input devices 232, the display 234, the I/O data port(s) 246, and certain components of the memory 236. The master/slave control program(s) 254 is illustrative of the programs that implement the various features of the data processing system 230. The data 256 represents the static and dynamic data used by the application programs such as the master/slave control program(s) 254, operating system 252, I/O device drivers 258, and other software programs that may reside in the memory 236.

As is further seen in FIG. 3, the application programs may include a master/slave control program(s) 254 which provides for control of the plating pulse rectifier 10 based on whether the plating pulse rectifier 10 is designated as a master or a slave device. Furthermore, the data portion of memory 236 may include recipe data 270 which specifies a pattern or series of patterns of pulses to be generated by the plating pulse rectifier 10 so as to carry out a desired plating operation.

Figure 4:
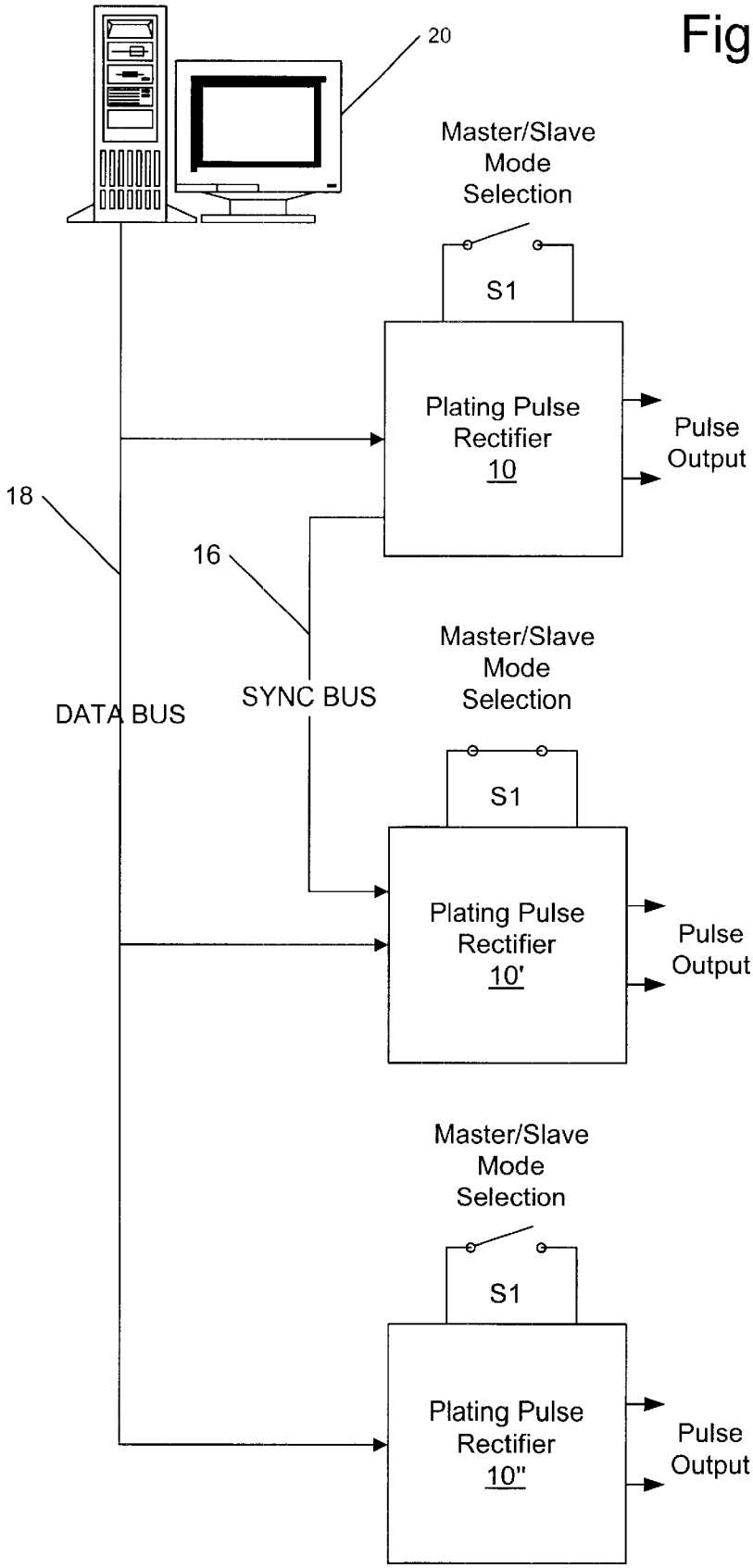
FIG. 4 is a block diagram of a system of plating pulse rectifiers according to embodiments of the present invention.

While the present invention is illustrated, for example, with reference to the master/slave control program(s) 254 being an application program, as will be appreciated by those of skill in the art, the master/slave control function may also be incorporated into the operating system 252 or the I/O device drivers 258. Thus, the present invention should not be construed as limited to the configuration of FIG. 3 but is intended to encompass any configuration capable of carrying out the operations described herein. FIG. 4 illustrates a plating system incorporating plurality of plating pulse rectifiers 10, 10' and 10" illustrated in FIG. 1A according to embodiments of the present invention. As is seen in FIG. 4, the system may include a recipe source such as the computer which may provide recipe data to the plating pulse rectifiers 10, 10' and 10" over the data bus 18. Such recipe data may be broadcast to all of the plating pulse rectifiers 10, 10' and 10" or each plating pulse rectifier 10, 10' and 10" may be individually addressable so that differing recipes could be provided. Such addresses may be provided by, for example, switch settings for the plating pulse rectifiers 10, 10' and 10" or by otherwise assigning unique addresses to the plating pulse rectifiers 10, 10' and 10".

In the system illustrated in FIG. 4, plating pulse rectifiers 10 and 10" have been designated by the position of their corresponding switches S1 to be master plating pulse rectifiers and plating pulse rectifier 10' has been designated by the position of its switch S1 as a slave plating pulse rectifier. Furthermore, the sync bus 16 has been connected between plating pulse rectifiers 10 and 10' so that plating pulse rectifier 10 will be synchronized with plating pulse rectifier 10'. Because plating pulse rectifier 10" has been designated as a master and is not connected to the sync bus 16, it may operate independent of plating pulse rectifiers 10 and 10'. Thus, the sync bus 16 is only connected between those devices that have a master/slave relationship.

In operation, the computer 20 may download recipes to the plating pulse rectifiers 10, 10' and 10" over the data bus. This download may be a serial data transfer in embodiments where the data bus is an RS-485 serial bus or may be a network transfer in embodiments where the data bus is a network. The download may be initiated by either the computer 20 or the plating pulse rectifiers 10, 10' and 10". In fact, the download could be achieved through a client-server architecture where the plating pulse rectifiers 10, 10' and 10" act as clients and the computer 20 acts as a server.

Furthermore, fewer than all of the plating pulse rectifiers 10, 10' and 10" may be loaded with recipes or differing recipes could be provided to the individually addressable plating pulse rectifiers 10, 10' and 10'. However, for purposes of illustration, at least plating pulse rectifiers 10 and 10' are loaded with the same recipe. After the recipes are loaded, at least the plating pulse rectifiers 10 and 10' initiate operation by the master plating pulse rectifier 10 sending a sync pulse to the slave plating pulse rectifier 10' indicating that it is outputting a pulse pattern of the commonly downloaded recipe. The slave plating pulse rectifier 10' receives the sync pulse and also initiates outputting the corresponding pulse pattern of its copy of the downloaded recipe.

The master plating pulse rectifier 10 may output a sync pulse each time a pulse pattern in the downloaded recipe is initiated and the slave plating pulse rectifier 10' initiates the corresponding pulse pattern in its downloaded recipe each time a sync pulse is received. Thus, the master plating pulse rectifier 10 and the slave plating pulse rectifier 10' may remain substantially synchronized even if clocks or other timing signals of the two plating pulse rectifiers 10 and 10' differ as the plating pulse rectifiers 10 and 10" are resynchronized at the start of each pulse pattern. Therefore, pursuant to particular embodiments of the present invention, the slave plating pulse rectifier starts the corresponding pulse pattern of the recipe upon receipt of the synchronization pulse even if it has not completed the previous pattern.

Figure 5:
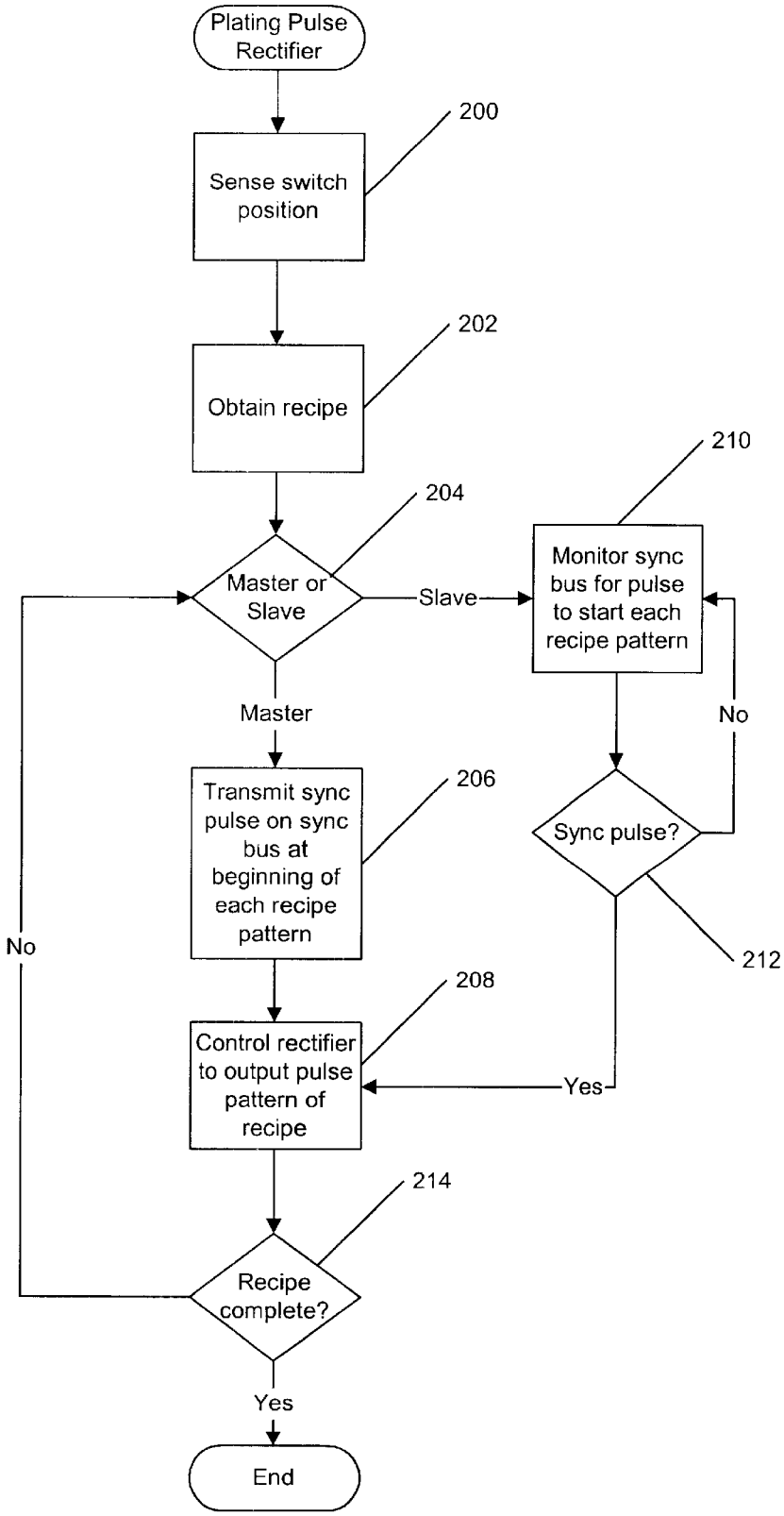
FIG. 5 is a flowchart illustrating operations of a plating pulse rectifier according to embodiments of the present invention.

Embodiments of the present invention will now be described in more detail with reference to FIG. 5 which is a flowchart illustration of operations of a plating pulse rectifier according to embodiments of the present invention. As seen in FIG. 5, the plating pulse rectifier may sense the master/slave switch position (block 200) or otherwise determine, as described above, whether it is a master or a slave plating pulse rectifier. The plating pulse rectifier also obtains a recipe which includes at least one pattern of pulses to be output by the plating pulse rectifier (block 202). This recipe is obtained irrespective of whether the plating pulse rectifier is a master or a slave.

The plating pulse rectifier then determines if it is a master or slave (block 204). If the plating pulse rectifier is a master plating pulse rectifier, then the plating pulse rectifier transmits the sync pulse on the sync bus at the beginning of a pattern in the recipe (block 206). The plating pulse rectifier also initiates output of the current pulse pattern of the recipe (block 208). These operations continue until the recipe is complete (block 214).

If the plating pulse rectifier is a slave plating pulse rectifier, then the plating pulse rectifier monitors the sync bus to wait for the sync pulse on the sync bus (block 210). When the sync pulse is received (block 212), the slave also initiates output of the current pulse pattern of the recipe (block 208). These operations continue until the recipe is complete (block 214).

While not illustrated in FIG. 5, if the plating pulse rectifier is a master, it may also wait for an indication that all of the slave plating pulse rectifiers have received the download of their recipes before transmitting the sync pulse and beginning execution of the recipe. Alternatively, the master plating pulse rectifier may be downloaded with the recipe and then it may transfer the recipe to the slave plating pulse rectifiers over the data bus or, even over the sync bus and, thereby, know when the download was complete. Furthermore, the master plating pulse rectifier could also wait for an input, for example, from an operator, indicating that the system was ready to begin executing its recipe.

The flowcharts and block diagrams of FIGS. 1A through 5 illustrate the architecture, functionality, and operation of possible implementations providing plating pulse rectifiers and master/slave control of plating pulse rectifiers according to the present invention. In this regard, each block in the flow charts or block diagrams represents a module, segment, or portion of code, which comprises one or more executable instructions for implementing the specified logical function (s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A method of controlling a plurality of plating pulse rectifiers, comprising:

identifying one of the plurality of plating pulse rectifiers as a master plating pulse rectifier;

identifying at least one of the plurality of plating pulse rectifiers, other than the master plating pulse rectifier, as a slave plating pulse rectifier;

downloading a recipe comprising a pulse pattern to the master plating pulse rectifier and the slave plating pulse rectifier; and transmitting a synchronization signal from the master plating pulse rectifier to the at least one slave plating pulse rectifier upon initiating the pulse pattern of the recipe so as to cause the slave plating pulse rectifier to initiate the pulse pattern of the downloaded recipe.

2. A method according to claim 1, wherein the step of transmitting is carried out at the initiation of each pulse pattern in the downloaded recipe.

3. A method according to claim 1, wherein the step of identifying one of the plurality of plating pulse rectifiers as a master plating pulse rectifier comprises the steps of:

setting a master/slave switch on the one of the plurality of plating pulse rectifiers identified as the master plating pulse rectifier to a master position; and reading the position of the master/slave switch to identify the one of the plurality of plating pulse rectifiers as the master plating pulse rectifier based on the position of the master/slave switch.

4. A method according to claim 3, wherein the step of reading the position of the master/slave switch is carried out at power up.

5. A method according to claim 1, wherein the step of identifying at least one of the plurality of plating pulse rectifiers as a slave plating pulse rectifier comprises the steps of:

setting a master/slave switch on the at least one of the plurality of plating pulse rectifiers other than the master plating pulse rectifier to a slave position; and reading the position of the master/slave switch to identify the at least one of the plurality of plating pulse rectifiers as a slave plating pulse rectifier based on the position of the master/slave switch.

6. A method according to claim 5, wherein the step of reading the position of the master/slave switch is carried out at power up.

7. A method according to claim 1, further comprising the steps of:

receiving the synchronization signal at the at least one of the slave plating pulse rectifier; and initiating the pulse pattern of the downloaded recipe responsive to receiving the synchronization signal.

8. A method according to claim 7, wherein the step of initiating the pulse pattern is carried out irrespective of whether a previous pulse pattern of the downloaded recipe has completed.

9. A method according to claim 1, wherein the step of downloading a recipe comprising a pulse pattern to the master plating pulse rectifier and the slave plating pulse rectifier comprises the steps of:

transmitting the recipe onto a data bus operably associated with the plurality of plating pulse rectifiers; and receiving the transmitted recipe at the master plating pulse rectifier and the at least one slave plating pulse rectifier.

10. A method according to claim 9, wherein the step transmitting the recipe onto a data bus comprises the steps of:

transmitting the recipe onto the data bus with a first address associated with the master plating pulse rectifier; and transmitting the recipe onto the data bus with a second address associated with the at least one slave plating pulse rectifier.

11. A method according to claim 9, wherein the step of transmitting the recipe onto a data bus comprises transmitting the recipe from the master plating pulse rectifier to the at least one slave plating pulse rectifier on the data bus.

12. A method according to claim 9, wherein the step of transmitting a synchronization signal from the master plating pulse rectifier upon initiating the pulse pattern of the recipe to the at least one slave plating pulse rectifier so as to cause the slave plating pulse rectifier to initiate the pulse pattern of the downloaded recipe comprises transmitting a synchronization pulse on a sync bus operably associated with the master plating pulse rectifier and the at least one slave plating pulse rectifier.

13. A plating pulse rectifier, comprising:

a control computer;

a power module operably associated with the control computer so as to output pulses based on control signals provided by the control computer;

master/slave mode selector operably associated with the control computer so as to define the plating pulse rectifier as either a master plating pulse rectifier or a slave plating pulse rectifier;

a data bus operably associated with the control computer and configured to receive recipes to be loaded into the control computer; and a sync bus operably associated with the control computer and configured so as to transmit synchronization signals if the plating pulse rectifier is a master plating pulse rectifier and receive synchronization signals if the plating pulse rectifier is a slave plating pulse rectifier.

14. A plating pulse rectifier according to claim 13, wherein the control computer is configured to transmit a synchronization signal on the sync bus at the start of a pattern of a recipe loaded in the control computer if the plating pulse rectifier is a master plating pulse rectifier.

15. A plating pulse rectifier according to claim 14, wherein the control computer is configured to receive a synchronization signal on the sync bus and control the power module to output a pattern pulse of a recipe loaded in the control computer responsive to receiving the synchronization signal.

16. A plating pulse rectifier according to claim 13, wherein the control computer is configured to receive a synchronization signal on the sync bus and control the power module to output a pattern pulse of a recipe loaded in the control computer responsive to receiving the synchronization signal.

17. A plating pulse rectifier according to claim 13, wherein the data bus comprises a RS-485 serial bus.

18. A plating pulse rectifier according to claim 13, wherein the sync bus comprises a RS-485 serial bus.

19. A plating pulse rectifier according to claim 13, wherein the master/slave mode selector comprises a switch operably associated with the control computer.

20. A plating pulse rectifier according to claim 19, wherein the switch is configured to provide a first voltage level to the control computer if the plating pulse rectifier is a master plating pulse rectifier and a second voltage level, different from the first voltage level, if the plating pulse rectifier is a slave plating pulse rectifier.

21. A plating pulse rectifier according to claim 20, wherein the control computer is further configured to read a voltage level provided by the switch and to define the plating pulse rectifier as a master plating pulse rectifier if the voltage level is the first voltage level and define the plating pulse rectifier as a slave plating pulse rectifier if the voltage level is a second voltage level.

22. A plating pulse rectifier according to claim 13, wherein the master/slave mode selector comprises a bit in a loadable control register in the control computer.

23. A plating pulse rectifier according to claim 22, wherein the loadable control register is loadable from the data bus.

24. A plating system, comprising:

at least two plating pulse rectifiers, wherein each of the at least two plating pulse rectifiers comprise:

a control computer;

a power module operably associated with the control computer so as to output pulses based on control signals provided by the control computer;

a master/slave mode selector operably associated with the control computer so as to define the plating pulse rectifier as either a master plating pulse rectifier or a slave plating pulse rectifier;

a data bus operably associated with the control computer and configured to receive recipes to be loaded into the control computer; and a sync bus operably associated-with the control computer and configured so as transmit synchronization signals if the plating pulse rectifier is a master plating pulse rectifier and receive synchronization signals if the plating pulse rectifier is a slave plating pulse rectifier; and wherein one of the at least two plating pulse rectifiers is defined as a master plating pulse rectifier and the other of the at least two plating pulse rectifiers is defined as a slave plating pulse rectifier.

25. A plating system according to claim 24, further comprising a computer operably associated with the plurality of plating pulse rectifiers and configured to download recipes to the plurality of plating pulse rectifiers.

26. A plating system according to claim 24, wherein the sync bus of the master plating pulse rectifier is operably connected to the sync bus of the slave plating pulse rectifier.

27. A plating system according to claim 26, wherein the sync bus of the master plating pulse rectifier is operably connected to only slave plating pulse rectifiers associated with the master plating pulse rectifier.

28. A system for controlling a plurality of plating pulse rectifiers, comprising:

means for identifying one of the plurality of plating pulse rectifiers as a master plating pulse rectifier;

means for identifying at least one of the plurality of plating pulse rectifiers, other than the master plating pulse rectifier, as a slave plating pulse rectifier;

means for downloading a recipe comprising a pulse pattern to the master plating pulse rectifier and the slave plating pulse rectifier; and means for transmitting a synchronization signal from the master plating pulse rectifier to the at least one slave plating pulse rectifier upon initiating the pulse pattern of the recipe so as to cause the slave plating pulse rectifier to initiate the pulse pattern of the downloaded recipe.

29. A system according to claim 28, wherein the means for transmitting comprises means for transmitting a synchronization signal at the initiation of each pulse pattern in the downloaded recipe.

30. A system according to claim 28, wherein the means for identifying one of the plurality of plating pulse rectifiers as a master plating pulse rectifier comprises:

a master/slave switch on the one of the plurality of plating pulse rectifiers identified as the master plating pulse rectifier, the master/slave switch being set to a master position; and means for reading the position of the master/slave switch to identify the one of the plurality of plating pulse rectifiers as the master plating pulse rectifier based on the position of the master/slave switch.

31. A system according to claim 30, wherein the means for reading the position of the master/slave switch comprises means for reading the position of the master/slave switch at power up.

32. A system according to claim 28, wherein the means for identifying at least one of the plurality of plating pulse rectifiers as a slave plating pulse rectifier comprises:

a master/slave switch on the at least one of the plurality of plating pulse rectifiers other than the master plating pulse rectifier, the master slave switch being set to a slave position; and means for reading the position of the master/slave switch to identify the at least one of the plurality of plating pulse rectifiers as a slave plating pulse rectifier based on the position of the master/slave switch.

33. A system according to claim 32, wherein the means for reading the position of the master/slave switch comprises means for reading the position of the master/slave switch at power up.

34. A system according to claim 28, further comprising:

means for receiving the synchronization signal at the at least one of the slave plating pulse rectifier; and means for initiating the pulse pattern of the downloaded recipe responsive to receiving the synchronization signal.

35. A system according to claim 34, wherein the means for initiating the pulse pattern comprises means for initiating the pulse pattern irrespective of whether a previous pulse pattern of the downloaded recipe has completed.

36. A system according to claim 28, wherein the means for downloading a recipe comprising a pulse pattern to the master plating pulse rectifier and the slave plating pulse rectifier comprises:

means for transmitting the recipe onto a data bus operably associated with the plurality of plating pulse rectifiers; and means for receiving the transmitted recipe at the master plating pulse rectifier and the at least one slave plating pulse rectifier.

37. A system according to claim 36, wherein the means for transmitting the recipe onto a data bus comprises:

means for transmitting the recipe onto the data bus with a first address associated with the master plating pulse rectifier; and means for transmitting the recipe onto the data bus with a second address associated with the at least one slave plating pulse rectifier.

38. A system according to claim 35, wherein the means for transmitting the recipe onto a data bus comprises means for transmitting the recipe from the master plating pulse rectifier to the at least one slave plating pulse rectifier on the data bus.

39. A system according to claim 35, wherein the means for transmitting a synchronization signal from the master plating pulse rectifier upon initiating the pulse pattern of the recipe to the at least one slave plating pulse rectifier so as to cause the slave plating pulse rectifier to initiate the pulse pattern of the downloaded recipe comprises means for transmitting a synchronization pulse on a sync bus operably associated with the master plating pulse rectifier and the at least one slave plating pulse rectifier.

40. A computer program product for controlling a plurality of plating pulse rectifiers, comprising:

a computer-readable storage medium having computer-readable program code embodied in said medium, said computer-readable program code comprising:

computer-readable program code which identifies one of the plurality of plating pulse rectifiers as a master plating pulse rectifier;

computer-readable program code which identifies at least one of the plurality of plating pulse rectifiers, other than the master plating pulse rectifier, as a slave plating pulse rectifier;

computer-readable program code which downloads a recipe comprising a pulse pattern to the master plating pulse rectifier and the slave plating pulse rectifier; and computer-readable program code which transmits a synchronization signal from the master plating pulse rectifier to the at least one slave plating pulse rectifier upon initiating the pulse pattern of the recipe so as to cause the slave plating pulse rectifier to initiate the pulse pattern of the downloaded recipe.

41. A computer program product according to claim 40, wherein the computer-readable program code which transmits comprises computer-readable program code which transmits a synchronization signal at the initiation of each pulse pattern in the downloaded recipe.

42. A computer program product according to claim 40, wherein the computer-readable program code which identifies one of the plurality of plating pulse rectifiers as a master plating pulse rectifier comprises:

computer-readable program code which reads the position of a master/slave switch to determine if the master/slave switch is set to a master position to identify the one of the plurality of plating pulse rectifiers as the master plating pulse rectifier based on the position of the master/slave switch.

43. A computer program product according to claim 42, wherein the computer-readable program code which reads the position of the master/slave switch comprises computer-readable program code which reads the position of the master/slave switch at power up.

44. A computer program product according to claim 40, wherein the computer-readable program code which identifies at least one of the plurality of plating pulse rectifiers as a slave plating pulse rectifier comprises:

computer-readable program code which reads the position of a master/slave switch to determine if the master/slave switch is set to a slave position to identify the at least one of the plurality of plating pulse rectifiers as a slave plating pulse rectifier based on the position of the master/slave switch.

45. A computer program product according to claim 44, wherein the computer-readable program code which reads the position of the master/slave switch comprises computer-readable program code which reads the position of the master/slave switch at power up.

46. A computer program product according to claim 40, further comprising:

computer-readable program code which receives the synchronization signal at the at least one of the slave plating pulse rectifier; and computer-readable program code which initiates the pulse pattern of the downloaded recipe responsive to receiving the synchronization signal.

47. A computer program product according to claim 46, wherein the computer-readable program code which initiates the pulse pattern comprises computer-readable program code which initiates the pulse pattern irrespective of whether a previous pulse pattern of the downloaded recipe has completed.

48. A computer program product according to claim 40, wherein the computer-readable program code which downloads a recipe comprising a pulse pattern to the master plating pulse rectifier and the slave plating pulse rectifier comprises:

computer-readable program code which transmits the recipe onto a data bus operably associated with the plurality of plating pulse rectifiers; and computer-readable program code which receives the transmitted recipe at the master plating pulse rectifier and the at least one slave plating pulse rectifier.

49. A computer program product according to claim 48, wherein the computer-readable program code which transmits the recipe onto a data bus comprises:

computer-readable program code which transmits the recipe onto the data bus with a first address associated with the master plating pulse rectifier; and computer-readable program code which transmits the recipe onto the data bus with a second address associated with the at least one slave plating pulse rectifier.

50. A computer program product according to claim 48, wherein the computer-readable program code which transmits the recipe onto a data bus comprises computer readable program code which transmits the recipe from the master plating pulse rectifier to the at least one slave plating pulse rectifier on the data bus.

51. A computer program product according to claim 48, wherein the computer-readable program code which transmits a synchronization signal from the master plating pulse rectifier upon initiating the pulse pattern of the recipe to the at least one slave plating pulse rectifier so as to cause the slave plating pulse rectifier to initiate the pulse pattern of the downloaded recipe comprises computer-readable program code which transmits a synchronization pulse on a sync bus operably associated with the master plating pulse rectifier and the at least one slave plating pulse rectifier.

* * * * *